US005600078A

United States Patent [19]

Edwards

[11] Patent Number: 5,600,078

[45] Date of Patent: Feb. 4, 1997

[54] ADJUSTABLE BRIDGE FOR A STRING INSTRUMENT

[76] Inventor: Nole F. Edwards, 11264 U.S. Highway 12, Randle, Wash. 98377

[21] Appl. No.: 373,899

[22] Filed: Jan. 17, 1995

[51] Int. Cl.[6] ..... G10D 3/04

[52] U.S. Cl. ..... 84/307; 84/312 R

[58] Field of Search ..... 84/297 R, 298, 84/307, 312 R

[56] References Cited

U.S. PATENT DOCUMENTS

| | | | |
|---|---|---|---|
| D. 259,119 | 5/1981 | Quan | 84/267 |
| 615,053 | 11/1898 | Utt | 84/298 |
| 3,396,284 | 8/1968 | Scherer | 310/8.3 |
| 4,385,543 | 5/1983 | Shaw et al. | 84/298 |
| 4,649,789 | 3/1987 | Wadatsu | 84/298 |
| 4,681,010 | 7/1987 | Wilkinson | 84/298 |
| 4,712,463 | 12/1987 | Kubicki et al. | 84/304 |
| 4,779,506 | 10/1988 | Takeuti | 84/313 |
| 4,951,543 | 8/1990 | Cipriani | 84/298 |
| 5,052,260 | 10/1991 | Cipriani | 84/298 |
| 5,198,601 | 3/1993 | McCabe | 84/298 |
| 5,208,410 | 5/1993 | Foley | 84/307 |
| 5,347,905 | 9/1994 | Cipriani | 84/298 |

*Primary Examiner*—Patrick J. Stanzione
*Attorney, Agent, or Firm*—William A. Birdwell & Associates

[57] ABSTRACT

A bridge for a string instrument having a body and at least one string. A base is provided for mounting the bridge on the body of the instrument. An intonation adjustment member is slidably mounted on the base for adjusting the horizontal position at which a string is supported by the bridge. A height adjustment member is slidably mounted on the intonation adjustment member for adjusting the vertical position of the string above the body. The intonation adjustment member has a ramp portion for slidably supporting the height adjustment member while maintaining substantially constant contact surface area. Horizontal position of the intonation adjustment member and vertical position of the height adjustment member are adjusted by respective elongate threaded shafts. The intonation adjustment member interlocks with the base, and the height adjustment member interlocks with the intonation adjustment member.

24 Claims, 4 Drawing Sheets

ADJUSTABLE BRIDGE FOR A STRING INSTRUMENT

BACKGROUND

This invention relates to bridges for string instruments, particularly bridges providing for adjustment of string height and of string intonation, while optimizing sustain characteristics of the musical instrument.

String instruments, such as electric and acoustic guitars, use bridges in establishing the intonation and height of each string. In that use, the sound and performance of the instrument depends on proper fit and adjustment of the bridge. Typically, a bridge is fitted to a string instrument and adjusted, together with the strings, in the manufacturing stage or otherwise prior to sale to the musician. The heights of the strings ideally are adjusted so that, in playing the instrument, the strings are readily and comfortably manipulated, but cannot incidentally contact other parts of the instrument. In a guitar, for example, if a string is too close to the guitar's fretted finger board, the string will produce an undesirable buzz as it makes incidental contact with one or more of the frets. In that case, improper string height detracts from the instrument's sound. On the other hand, if the string is too high, the action of the guitar suffers, as the musician must move the strings an excessive distance to reach the fingerboard. In that case, improper string height detracts from the instrument's performance. In both cases, the musician's pleasure in playing the instrument is impaired and, in turn, the musician's performance is likely to suffer.

Even if the bridge is properly fitted and adjusted in the manufacturing stage, it is generally desirable for the musician thereafter to be able to adjust the bridge so as to adjust the height and intonation of each string. For example, a musician may need or want to adjust string height after modifying the instrument, such as by replacing the strings with strings of different gauge or type, or in response to the musician's increased skills, changed playing style or otherwise. In turn, the musician may need or want to change the intonation of one or more strings, that change being accomplished by adjusting the point on the string at which it is seated on the bridge.

While such adjustability is desirable, it is also generally desirable for the musician to be able to so adjust each string independently of the other strings and to be able to make height adjustments substantially separately from intonation adjustments for any one string. Moreover, it is highly desirable to be able to so adjust each string without otherwise negatively affecting the sound and performance of the instrument. In particular, it is highly desirable to provide such adjustability while optimizing the sustain characteristics of the instrument.

Conventional bridges have provided various means for adjusting string height and intonation. These conventional bridges, however, each have significant limitations. In one conventional form, for example, the bridge is mounted on the body of the musical instrument using a screw at either side, while employing a thumb nut or similar element on each screw to permit raising or lowering of the entire bridge. An example of this conventional bridge form is shown in Scherer U.S. Pat. No. 3,396,284.

This conventional bridge form suffers from serious drawbacks, including that adjustment is only operative for raising or lowering all of the strings, rather than being adapted to adjust individually the height of each string. In addition, uniform height for all strings, when desired, can be difficult to attain due to difficulty in adjusting the screws at either side of the bridge. Moreover, while this bridge form provides for string height adjustment, its use adversely affects the sound and performance of the instrument, in particular as to the instrument's sustain characteristics. The sustain characteristics are adversely affected because the contact between the bridge and the body of the instrument is made only by the two screws, the contact being inadequate to sustain string vibration.

Another conventional bridge form overcomes some of the problems indicated above by providing separate adjustment for each bridge saddle. Examples of this conventional bridge form are shown in Shaw et al. U.S. Pat. No. 4,385,543 and Wadatsu U.S. Pat. No. 4,649,789. However, bridges following this second conventional form are also subject to significant limitations, including by adversely affecting the sound and performance of the instruments, again particularly as to sustain characteristics. For example, sustain characteristics are adversely affected because contact between the bridge and the body of the instrument generally is limited to the end of one or more screws. In addition, bridges of this second conventional form tend to suffer from complexity in design making them difficult to use in adjusting the height or intonation of the strings, as well as increasing the possibility for improper adjustment which, in turn, adversely affects the sound and performance of the instrument.

Because conventional forms of adjustable bridges for string instruments have inherent limitations, a need exists for an improved adjustable bridge.

SUMMARY

The present invention fulfills the need for an improved adjustable bridge for a string instrument, overcomes the limitations of prior art bridges and provides certain advantages not heretofore available in such bridges, by providing a bridge having a base mountable on the body of the instrument, one or more height and intonation adjustment mechanisms, and respective coupling mechanisms by which each adjustment mechanism is adjustably coupled to the base. Each adjustment mechanism is associated with a respective string and provides for height and intonation adjustment of such string independently of the other strings, the height adjustment of an adjustment mechanism being performed substantially separately from the intonation adjustment, and such adjustments being achieved while optimizing the sustain characteristics of the instrument. Each coupling mechanism provides for maintaining contact area between the base and the respective adjustment mechanism sufficient to optimize sustain characteristics.

In one embodiment of the invention, the bridge includes a base for mounting said bridge on the body of the instrument; an intonation adjustment member, slidably mounted on the base, for adjusting the horizontal position at which a string is supported by the bridge; and a height adjustment member, slidably mounted on the intonation adjustment member, for adjusting the vertical position of the string above the body. The intonation adjustment member has a ramp portion for slidably supporting the height adjustment member, the ramp forming an acute angle with the base. The intonation adjustment member is connected to the base by an interlocking, slidable engagement mechanism, the engagement mechanism providing either a constant or at least a minimum threshold of surface area of contact between the member and the base. The height adjustment member is connected to the intonation adjustment member by an interlocking, slidable engagement mechanism, the engagement mechanism providing either a constant or at least a minimum threshold of surface area of contact between the members. Preferably one or both of the interlocking, slidable engagement mechanisms comprise a dovetail interconnection.

The bridge further includes a horizontal positioning member and a vertical positioning member. The horizontal positioning member is connected to the base and to the intonation adjustment member, for selectively adjusting the horizontal position of the intonation adjustment member. The horizontal positioning member preferably comprises a first elongate threaded shaft rotatably connected to the base and matingly engaging a threaded aperture in the intonation adjustment member, and a first coil spring disposed around the first elongate threaded shaft between the base and the intonation adjustment member. The vertical positioning member is connected to the intonation adjustment member and to the height adjustment member, for selectively adjusting the vertical position of the height adjustment member. The vertical positioning member preferably comprises an second elongate threaded shaft rotatably connected to the intonation adjustment member and matingly engaging a threaded aperture in the height adjustment member, and a second coil spring disposed around the second elongate threaded shaft between the adjustment members.

Accordingly, it is a principal object of the present invention to provide a novel and improved bridge for a string instrument.

It is another object of the present invention to provide a bridge for a string instrument that accommodates adjustment of the height and intonation of each string of the instrument.

It is a further object of the present invention to provide a bridge for a string instrument that accommodates adjustment of the height and intonation of each string independently of the other strings of the instrument.

It is yet another object of the present invention to provide a bridge for a string instrument that accommodates adjustment of the height of a string substantially separately from adjustment of the intonation of the string.

It is yet a further object of the present invention to provide a bridge for a string instrument that accommodates adjustment of each string substantially without adversely affecting the sound and performance of the instrument.

It is still another object of the present invention to provide a bridge for a string instrument that accommodates height and intonation adjustment of each string without adversely affecting the sustain characteristics of the instrument.

It is still a further object of the present invention to provide a bridge for a string instrument that accommodates height and intonation adjustment of each string while optimizing the sustain characteristics of the instrument.

It is another object of the present invention to provide a bridge that accommodates adjustment of a string while providing progressively larger surface areas between respective bridge parts from the bridge to the base of the instrument, regardless of adjustment of the string.

It is a further object of the present invention to provide a bridge for a string instrument that accommodates adjustment of a string while maintaining substantially constant surface areas of contact between respective bridge parts from the bridge to the body of the instrument, regardless of adjustment of the string.

It is yet another object of the present invention to provide a bridge for a string instrument that accommodates adjustment of a string while maintaining above a selected minimum the surface areas of contact between respective bridge parts from the bridge to the body of the instrument, regardless of adjustment of the string.

It is yet a further object of the present invention to provide a bridge for a string instrument that accommodates adjustment of a string while maintaining above a selected minimum the mass of respective bridge parts from the bridge to the body of the instrument, regardless of adjustment of the string.

It is still another object of the present invention to provide a bridge for a string instrument that accommodates adjustment of a string while providing respective bridge parts of progressively larger masses from the bridge to the body of the instrument, regardless of adjustment of the string.

It is still a further object of the present invention to provide a bridge for a string instrument that accommodates adjustment of a string while providing respective bridge pans of close mutual tolerances so that relative motion therebetween is smooth and substantially absent free-play.

It is another object of the present invention to provide a bridge for a string instrument that accommodates adjustment of a string in height and intonation, the adjustments being accomplished while substantially maintaining string tension.

It is a further object of the present invention to provide a bridge for a string instrument that accommodates adjustment of a string, the bridge substantially holding the adjustments thereafter, regardless of adjustment of the string and use of the instrument.

It is yet another object of the present invention to provide a bridge for a string instrument that accommodates adjustment of a string in height and intonation, while providing a minimum number of pans and spreading mechanical forces over surface areas thereamong so as to be relatively durable.

It is yet a further object of the present invention to provide a bridge for a string instrument that accommodates adjustment of a string and that is compact and simple in design, inexpensive to manufacture and install, and easy to use.

The foregoing and other objects, features and advantages of the invention will be more readily understood upon consideration of the following detailed description of the invention, taken in conjunction with the accompanying drawings.

DETAILED DESCRIPTION

Figure 1:
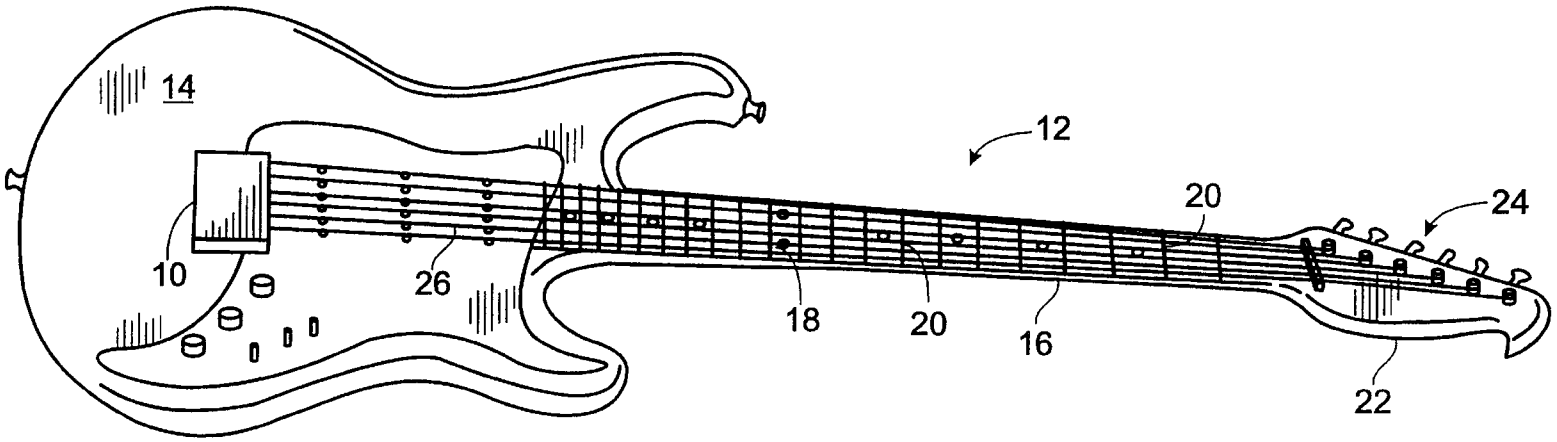
FIG. 1 is a plan view of a preferred embodiment of a bridge according to the present invention, installed on an electric guitar.

Referring to FIG. 1, a preferred embodiment of an adjustable bridge 10 in accordance with the present invention is shown installed on an electric guitar 12. The guitar 12 includes a body 14, a neck 16 extending from the body and a finger board 18 mounted over both the neck 16 and a portion of the body 14 opposite the bridge 10. The finger board 18 has frets 20 disposed at predetermined locations along its longitude. A head 22 is formed at the end of the neck 16 opposite the body 14, the neck 22 having a plurality of tuning peg assemblies 24. Strings 26, at one end, are fixed to respective tuning peg assemblies 24 and, at the other end, preferably terminate at the bridge 10. Although the bridge 10, as shown, is installed on the electric guitar 12, it is to be recognized that the guitar 12 is merely exemplary of the string instruments with which the bridge 10 can be used. Moreover, although the strings 26, as shown, terminate at the bridge 10, it is to be understood that the strings 26 may terminate at structure separate from the bridge 10. For example, the strings 26 can terminate at a tail piece or other anchoring assembly, the structures of which are known in the art.

Referring to FIGS. 2, 3, 5, and 6, one embodiment of the bridge 10 comprises a base 28, one or more adjustment mechanisms 30 and respective coupling mechanisms 31 by which each adjustment mechanism 30 is adjustably coupled to the base 28. Each adjustment mechanism 30 is associated with a respective string 26 and provides for height and intonation adjustment thereof. Each coupling mechanism 31 couples a respective adjusting mechanism 30 to the base 28 so that the adjustment mechanism 30 is maintained in contact with the base 28 regardless of adjustments of the adjustment mechanism 30. In doing so, the coupling mechanism 31 preferably provides for the adjustment mechanism 30 to be adjustably positionable relative to the base 28 in a plane substantially parallel to the base 28 and in a direction substantially along the longitude of the respective string 26. As described further below, each coupling mechanism 31 preferably is formed by the respective adjustment mechanism 30 having structure that mates with complementary structure associated with the base 28 and providing smooth, adjustable positioning while minimizing free-play and optimizing contact area between the two elements.

Figure 2:
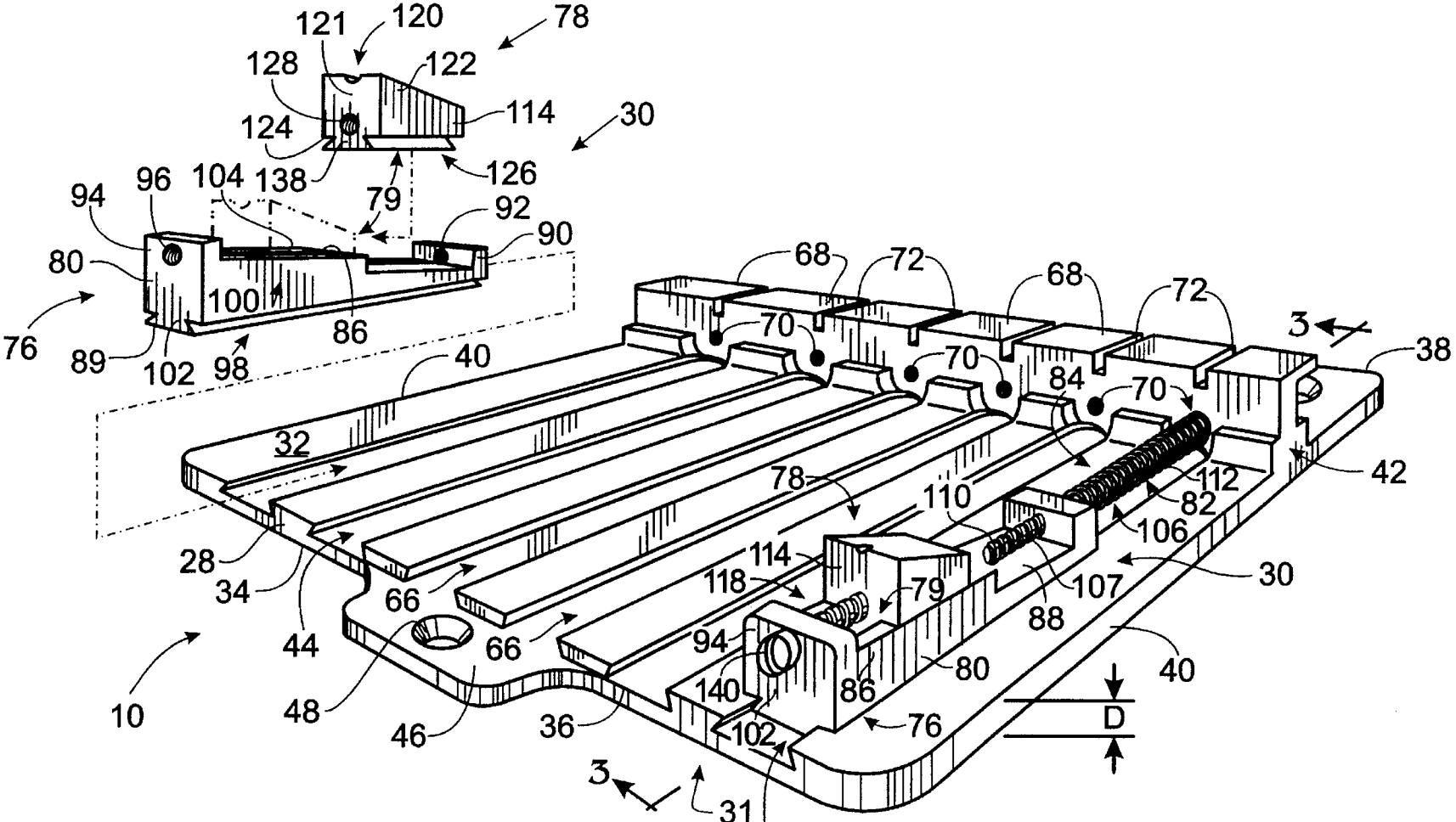
FIG. 2 is a perspective, partially exploded, view of a bridge according to the present invention.
Figure 6:
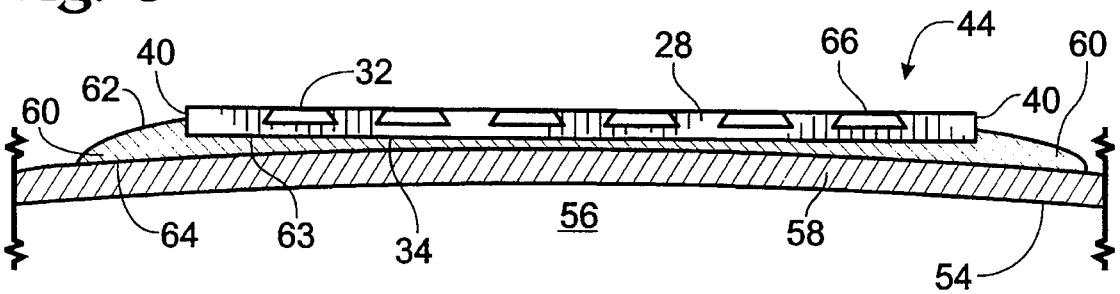
FIG. 6 is a cross-sectional, cut away view of an adaptor for use in mounting the bridge of FIGS. 1 and 2 to an archtop string instrument.

The base 28 preferably includes a top surface 32, a bottom surface 34, a front edge 36, a rear edge 38, side edges 40, rear wall 42, coupling portions 44, a lip 46 and mounting apertures 48. The coupling portions 44 of the base, as shown in FIGS. 2 and 6, comprise dovetail-shaped channels 66 formed in the top surface 32 of the base 28. The channels 66 extend substantially from the front edge 36 of the base 28 to the rear wall 42. Channels 66, among other things, define approximately the range of positions for the adjustment mechanisms 30. It is to be recognized that the coupling portions 44 can be other than the channels 66 and, if channels 66 are used, can be other than dovetail-shaped, without departing from the principles of the invention. The important point is that, together with complementary structure associated with the adjustment mechanisms 30, the coupling portions 44 form the coupling mechanisms 31.

The top surface 32 and the bottom surface 34 of the base 28 preferably are substantially planar. Moreover, the surfaces 32 and 34 preferably form substantially parallel planes separated by a selected, substantially constant distance D. Distance D is selected based on one or more of several factors, including the materials used in constructing the bridge, the mass desired to sustain string vibration, the method by which the base 28 is mounted to the body 14, and the desired minimum string height. Although planar surfaces 32 and 34 are preferred, it is to be recognized that one or both surfaces 32 and 34, or a portion or portions of either or both, may be other than planar, without departing from the principles of the invention. For example, the bottom surface 34 can be contoured to conform to the contour of the string instrument with which the bridge 10 is to be used. It is also to be recognized that the distance separating the top and bottom surfaces 32 and 34 can vary, without departing from the principles of the invention. For example, the surfaces 32 and 34 can form an angle so that the adjustment mechanisms 30 can be moved to discrete or continuously varying heights relative to the guitar body 14, these heights being either the same or variable among the adjustment mechanisms 30.

Figure 5:
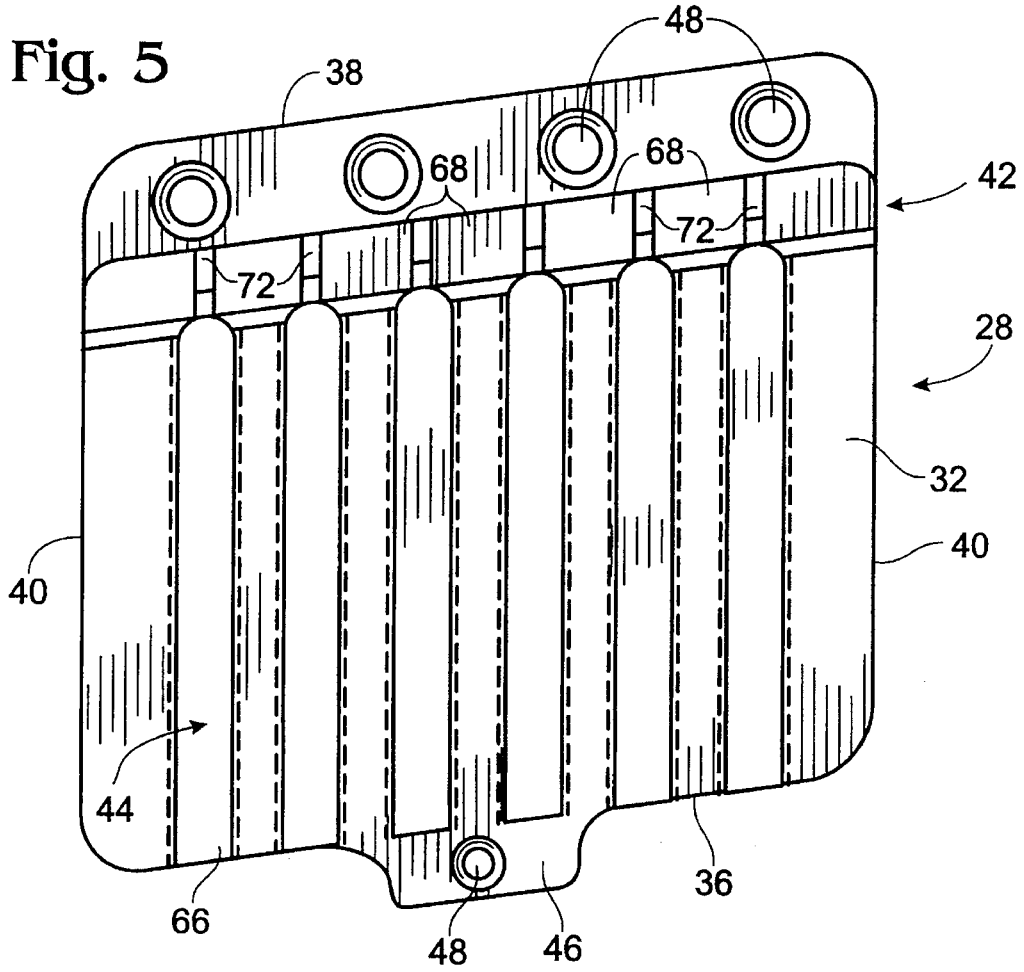
FIG. 5 is an alternative structure for use in the bridge of FIGS. 1 and 2.

The base 28, as shown in FIG. 2, is substantially rectangular but, as shown in FIG. 5, can be a substantially non-rectangular parallelogram. The parallelogram shape reflects that the strings 26 have different intonations and, therefore, have effective adjustment ranges centered on different preset bridge positions. That is, the channel 66 associated with a string having a particular intonation can be offset forward of the channel 66 associated with a string having a different intonation. So offsetting all strings accommodates having the parallelogram-shaped base 28, while maximizing the intonation adjustability for all of the strings relative to respective preset positions. Although these parallelogram shapes are shown, it is to be recognized that the top surface of the base 28 may have other shapes, including trapezoidal shapes, without departing from the principles of the invention.

The lip 46 extends substantially centrally from the front edge 36 of the base 28. The lip 46 has a mounting aperture 48 therethrough for receiving a screw 50, the screw 50 employed in mounting the base 28 to the guitar body 14. The top surface of the lip 46 preferably is at or below the channels 66 so as not to impair operation of the coupling mechanisms 31 and, in particular, so that the lip 46 and screw 50 together cannot interfere with positioning the adjustment mechanisms 30.

Figure 3:
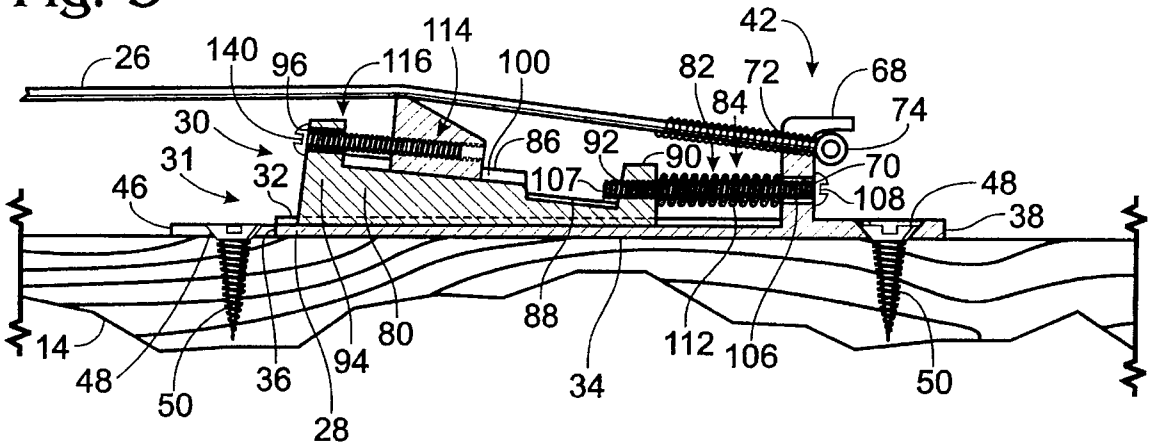
FIG. 3 is a cross-sectional view of the bridge of FIG. 2, taken along line 3—3 thereof.

The rear wall 42 of the base 28 extends uprightly away from the base 28, substantially from one side edge 40 to the other. The rear wall 42 includes a flange 68 directed toward the rear edge 38 of the base 28. The rear wall 42 also includes a plurality of control apertures 70 therethrough and guides 72 therein, each preferably being in number equal to the number of strings 26. The control apertures 70, guides 72 and channels 66 preferably are substantially aligned in a vertical axis and have collinear longitudinal axes. As shown in FIG. 3 and described further below, the control apertures 70 are associated with adjustment controls employed to control the positions of respective adjustment mechanisms 30. As also shown in FIG. 3, the guides 72 are employed to receive respective strings 26 therethrough so that the ball 74 at the bridgeend of the respective strings 26 can be held, by string tension, against the rear wall 42 and the flange 68.

The rear wall 42 and the base 28 preferably are formed as one piece, as shown. However, it is to be recognized that the rear wall 42 may be separate from the base 28, being fixed thereto using any method known in the art, without departing from the principles of the invention.

The base 28 is mounted on the body 14 of the guitar 12 using screws 50 disposed through respective mounting apertures 48 and into the guitar body. It is to be recognized, however, that the base 28 can be mounted to the guitar 12 or other stringed instrument in other ways and, in particular, in any way that optimizes the sound and performance of the instrument. For example, the base 28 can be mounted using fasteners other than screws, adhesives, cements, tapes, ultrasonic bonding, welds or any other suitable means.

Referring to FIG. 6, the base 28 is shown in cross-section, mounted to a string instrument 54 having hollow body 56 and an arcuate top 58, as is characteristic of archtop acoustic guitars. To so mount the base 28, an adaptor 60 is interposed between the base 28 and the arcuate top 58. The adaptor 60 has a top face 62 that includes a seating surface 63 complementary to, and on which is seated, the bottom surface 34 of the base 28. The adaptor 60 also has a bottom face 64 complimentary to and mounted on the arcuate top 58, preferably using adhesives, cements, tapes or other means which do not penetrate the body 56; it is to be understood, however, that mounting can be accomplished using a penetrating means, without departing from the principles of the invention. In turn, the base 28 is secured to the adaptor 60 using any suitable means, as described above as to mounting the base 28 directly on the body 14 of the guitar 12.

Each adjustment mechanism 30 comprises an intonation adjustor 76, a height adjustor 78 and an adjustor coupling mechanism 79 by which each height adjustor 78 is coupled, preferably slidably, to the respective intonation adjustors 76. Each adjustor coupling mechanism 79 couples respective adjustors 76 and 78 so that contact therebetween is maintained regardless of the relative positions of the adjustors. As shown in FIGS. 2 and 3, the adjustor coupling mechanisms 79, together with the coupling mechanisms 31, resuk in the strings 26, adjustment mechanisms 30 and base 28 attaining a generally stacked arrangement; in particular, each string 26 is seated on the respective height adjustors 78 which, in turn, is seated on the respective intonation adjustor 76 and coupled thereto by the adjustor coupling mechanisms 79, the intonation adjustor 76 being seated, in turn, on the base 28 and coupled thereto by the coupling mechanism 31. Accordingly, when a string 26 generates a note, bridge 10 introduces a minimum of dampening and energy losses, thereby optimally sustaining the string's vibration.

The intonation adjustor 76 includes an intonation adjustor member 80, and intonation adjustor control 82 and a biasing mechanism 84. The intonation adjustor member 80 comprises a ramp portion 86, a hollow portion 88, a bottom 89, a rear flange portion 90 having an aperture 92 therethrough, a front flange portion 94 having an aperture 96 therethrough, a first coupling portion 98 and a second coupling portion 100. The ramp portion 86 of the intonation adjustor member 80 has a selected length $L_1$, a maximum height $H_1$ and a minimum height $H_2$. The difference between $H_1$ and $H_2$ defines the range of string height adjustment that can be obtained by operation of the height adjustor 78. Moreover, the length $L_1$, together with the difference in heights $H_1$ and $H_2$ over that length and with the operation of the associated adjustor control 82, determines the precision of string height adjustment. Generally, for a given height difference, longer lengths $L_1$ engender more precise height adjustment, while shorter lengths $L_1$ engender less precise, but more rapid height adjustment. Accordingly, the lengths $L_1$ and the heights $H_1$ and $H_2$ are selected so as to achieve the desired adjustment characteristic.

The ramp portion 86 and the bottom 89 of the intonation adjustor member 80 preferably are each substantially planar so as to conform to the surfaces of the height adjustor 78 and base 28 on which they are respectively seated and along which they are respectively moved, preferably by sliding action. As described above, the top surface 32 of the base 28 preferably is substantially planar. Accordingly, the bottom 89 of the adjustment member 80 is substantially planar so as to seat on the base 28 within acceptably fine tolerances and to obtain substantially smooth motion therebetween. Similar relationships apply to the ramp portion 86 in relation to the height adjustor 78.

The first coupling portions 98 of the intonation adjustor members 80, as shown in FIG. 2, comprise dovetail-shaped tenons 102 formed along the bottom 89 of each member 80. The tenons 89 mate with the respective channels 66 formed in the top surface 32 of the base 28 so as to form the coupling mechanisms 31 that couple the adjustment mechanisms 30 to the base 28. Preferably, the tenons 102 and the channel 66 are formed to complement one another to a very high tolerance so that, between these two elements free-play is minimized while substantially smooth sliding motion is achieved.

The second coupling portions 100 of the intonation adjustor members 80, as shown in FIGS. 2 and 3, comprise dovetail-shaped channels 104 formed in the ramp portions 86 of the respective intonation adjustor members 80. The channels 104 extend substantially from the front flange portion 94 to the rear flange portion 90. Channels 104, among other things, contribute in determining the range of string heights attainable by the height adjustor 78. It is to be recognized that the second coupling portions 100 can be other than the channels 104 and, if channels 104 are used, can be other than dovetail-shaped, without departing from the principles of the invention. The important point is that, together with the complementary structure associated with the height adjustor 78, the second coupling portions 100 form the adjustor coupling mechanisms 79.

The rear and front flange portions 90 and 94 of the intonation adjustor members 80 extend uprightly away from the bottom 89. The apertures 92 and 96, disposed respectively therethrough, receive and support the intonation adjustor control 82.

The intonation adjustor controls 82 each comprise a bolt 106 having a shaft 107 and a head 108, the shaft 107 having threads 110. The biasing mechanisms 84 each comprise a respective compression spring 112 disposed between and engaging both the rear flange portion 90 of the respective intonation adjustor member 80 and the rear wall 42 of the base 28. The bolt shaft 107 is disposed through the respective compression spring 112. Although the intonation adjustor controls 82 and the biasing mechanisms 84, as shown, comprise the bolts 106 and the springs 112, respectively, it is to be recognized that these elements 82 and 84 may be implemented using other structure without departing from the principles of the invention.

The bolts 106 pass through both the respective control aperture 70 of the rear wall 42 of the base 28 and the respective aperture 92 of the rear flange portion 90 of the intonation adjustor member 80. As shown in FIG. 3, the head 108 of each bolt 106 is disposed rearwardly of the rear wall 42, and the bolt 106 engages each of the respective apertures 70 and 92 by means of bolt threads 110 screwing into the apertures' internal threads. In another embodiment, the bolts 106 threadedly engage only one of its respective apertures 70 and 92, the unthreaded engagement being achieved either by employing an unthreaded aperture 70 or 92 or by having an unthreaded shaft portion, or both. In any case, close tolerances are preferred between the bolts 106 and the respective apertures 70 or 92 comprising each unthreaded engagement, so as to minimize any free-play in this aspect of the bridge 10.

In operation, the intonation of any selected string 26 is adjusted by adjusting the respective intonation adjustor member 80, which itself is adjusted using the intonation adjustor control 82. In the embodiment shown, the member's position is adjusted by turning the bolt 106, preferably by application of rotational torque of appropriate angular direction to the bolt head 108. Doing so moves the intonation adjustor member 80 along the base 28, forwardly or backwardly, depending on the direction of the applied torque, while the member 80 and base 28 remain in full contact by operation of the coupling mechanism 31. Any slack in the connection between the intonation adjustor member 80 and control 82, such as by having free-play in the threaded or unthreaded engagements, is taken up by the respective biasing mechanism 84. Where the biasing mechanism 84 comprises the compression spring 112, the spring 112 preferably is selected so that, regardless of the positions to which the intonation adjustor member 80 is adjustably moved, the spring 112 maintains contact with both the rear wall 42 and the rear flange portion 90, thereby taking up any slack that may be introduced by the adjustment operation and associated bridge structure.

Proper cooperation between the intonation adjustor member 80 and the intonation adjustor control 82 is important to maintenance of an optimum range of intonation adjustment. Several factors contribute to maintenance of the adjustment range, including the length $L_2$ of the hollow portion 88 of the intonation member 80, the incline of the hollow portion 88 relative to the longitudinal axis of the bolt shaft 107, and the height $H_2$ associated with the rear of the ramp portion 86 of the intonation adjustor member 80. For example, if rotating the bolt 106 causes it to screw through the rear flange portion 90 so as to lengthen the amount of the bolt shaft 107 protruding forwardly of the flange portion 94, the shaft 107 can come in contact with the hollow portion 88 or with the intonation adjustor member 80 at the rear of the ramp portion 86, thereby limiting further adjustment. In applications where any such limitation is undesirable, the limitation may be overcome employing one or more of several techniques, including lowering the hollow portion 88 below the longitudinal axis of the bolt shaft 107, by maximizing the length $L_2$ of the hollow portion 88, or by including an aperture (not shown) disposed through the intonation adjustor member 80 so as to receive the shaft 107 upon its reaching the rear of the ramp portion 86, or by a combination of the above. In another embodiment, the bolt 106 can unthreadedly engage the aperture 92 of the rear flange portion 90 and be fitted with fixed retaining members (not shown) along the shaft forwardly and rearwardly of the flange portion 90 such that, in making adjustments by turning the bolt, the bolt shaft 107 remains fixed in position relative to the rear flange portion 90 during back and forth adjustments of the intonation adjustor member 80.

In any case, it is preferred to pre-set the intonation adjustor member 80 in manufacturing the bridge 10, if only to center the member 80 in its adjustment range along the base 28.

Each height adjustor 78 comprises a height adjustor member 114, a height adjustor control 116 and a biasing mechanism 118. Each height adjustor member 114 comprises a string seat 120, front face 121, a beveled portion 122, a bottom 124, a coupling portion 126 and a threaded aperture 128. The string seat 120, preferably comprising a notch, receives a respective string 26. It is to be recognized that the string seat 120 can comprise structure other than a notch without departing from the principles of the invention; for example, the string seat 120 can be implemented using a roller assembly or otherwise. As described above, the bottom 124 of the height adjustor member 114 preferably is substantially planar so as to conform to the surface of the ramp portion 86 of the intonation adjustor member 80. Specifically, the bottom 124 of the height adjustor member 114 is substantially planar so as to seat on the ramp portion 86 within acceptably fine tolerances and to obtain substantially smooth sliding motion therebetween.

The coupling portions 126 of the height adjustor members 114, as shown in FIG. 2, comprise dovetail-shaped tenons 130 formed along the bottom 124 of the members 114. The tenons 130 mate with the channels 104 formed in the ramp portions 86 of the respective intonation adjustor members 80, so as to form the adjustor coupling mechanisms 79 that couple the height adjustors 78 to the intonation adjustors 76. Preferably, the tenons 130 and the channels 104 are formed to complement one another to a very high tolerance so that, between these elements, free-play is minimized while substantially smooth sliding motion is achieved.

Each height adjustor control comprises a bolt 140, while each biasing mechanism 118 comprises a compression spring 112 disposed between and engaging both the front flange portion 94 of the respective intonation adjustor member 80 and the front face 121 of the respective height adjustor member 114. Because the structure and operation of the height adjustor controls 116 and associated biasing mechanisms 118 are substantially similar to, respectively, the intonation adjustor controls 82 and the biasing mechanisms 84 of the intonation adjustors 76, description of such structure and operation, including its cooperation with the apertures 128 of the height adjustor members 114 and the apertures 96 of the front flange portions 94 of the intonation adjustor members 80 will not be repeated here.

Each beveled portion 122 of the height adjustor member 114 has an angle selected so that the string 26 seated in the string seat 120 does not otherwise make contact with the member 114. The angle is selected, relative to the top surface 32 of the base or otherwise, based on one or more of several factors, including: the relative angle of the ramp portion 86 of the respective intonation adjustor member 80, the maximum anticipated height of the string seat 120, the height of the string ball 74 when held by the rear wall 42 of the base 28, the height of the front face 121 of the height adjustor member 114, and the range over which the intonation adjustor member 80 may be adjustably positioned.

Figure 4A:
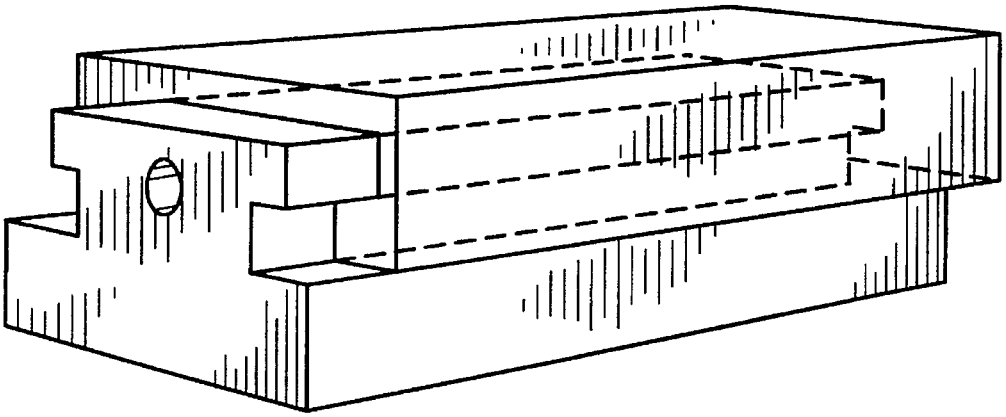
FIGS. 4A and 4B are perspective views of alternative structures for use in the bridge of FIGS. 1 and 2.
Figure 4B:
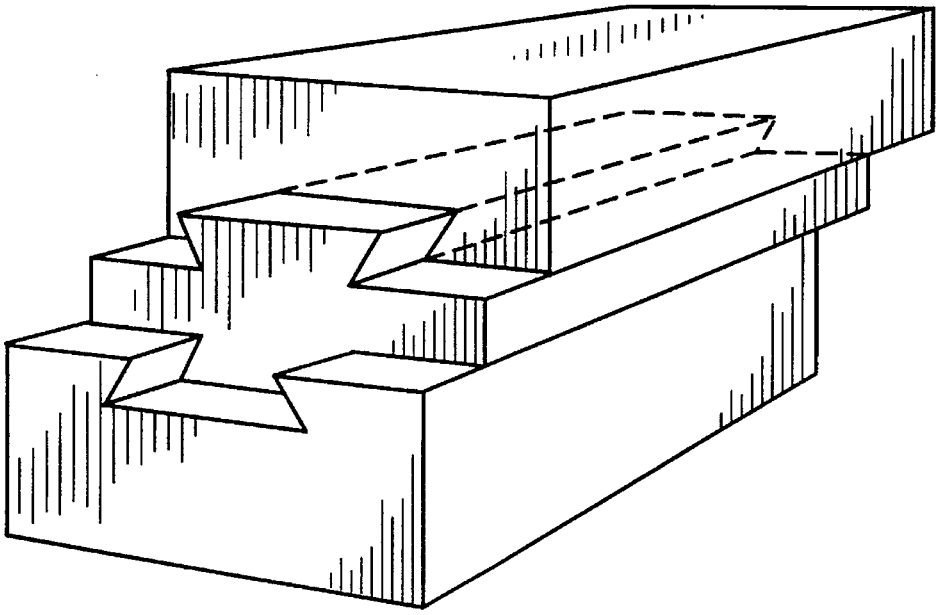

Referring to FIGS. 4A and 4B alternative structures are shown for the coupling mechanisms 31 and adjustor coupling mechanisms 79. In both cases, the coupling mechanisms comprise elements formed to complement one another to a very high tolerance so that, between coupled elements, flee-play is minimized while substantially smooth sliding motion is achieved.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A bridge for a string instrument having a body and at least one string, comprising:

a base for mounting said bridge on the body of the instrument; and an intonation adjustment member, slidably mounted on said base, for adjusting the horizontal position at which a string is supported by said bridge, wherein said intonation adjustment member includes a height adjustment member, movably mounted on said intonation member, for adjusting the vertical position of said the string relative to said intonation adjustment member and thereby adjusting the vertical position of the string above the body.

2. The bridge of claim 1, further comprising a intonation adjustment control, connected to said base and to said intonation adjustment member, for selectively adjusting the horizontal position of said intonation adjustment member.

3. The bridge of claim 2, wherein said intonation adjustor control comprises a first elongate threaded shaft rotatably connected to said base and matingly engaging a threaded aperture in said intonation adjustment member.

4. The bridge of claim 3, wherein said intonation adjustor control further comprises a first coil spring disposed around said first elongate threaded shaft between said base and said intonation adjustment member.

5. The bridge of claim 4, wherein said base includes a rear wall having an aperture therein for receiving said first elongate threaded shaft, said first coil spring being disposed between said intonation member and said rear wall.

6. The bridge of claim 5, wherein said rear wall includes an upper flange, said flange having a slotted aperture therein for receiving the string.

7. The bridge of claim 3, wherein said base includes a rear wall having an aperture therein for receiving said first elongate threaded shaft.

8. The bridge of claim 7, wherein said rear wall includes an upper flange, said flange having a slotted aperture therein for receiving the string.

9. The bridge of claim 3, further comprising a height adjustor control, connected to said intonation adjustment member and to said height adjustment member, for selectively adjusting the vertical position of said height adjustment member, said intonation adjustment member having a ramp portion for slidably supporting said height adjustment member.

10. The bridge of claim 9, wherein said intonation adjustment member is in interlocking, slidable engagement with said base, and said height adjustment member is in interlocking, slidable engagement with said intonation adjustment member.

11. The bridge of claim 9, wherein said ramp portion forms an acute with said base.

12. The bridge of claim 1, further comprising height adjustor control, connected to said intonation adjustment member and to said height adjustment member, for selectively adjustment the vertical position of said height adjustment member, said intonation adjustment member having a ramp portion for slidably supporting said height adjustment member.

13. The bridge of claim 12, wherein said height adjustor control comprises an elongate threaded shaft rotatably connected to said intonation adjustment member and matingly engaging a threaded aperture in said height adjustment member.

14. The bridge of claim 1, wherein said intonation adjustment member is connected to said base by an interlocking, slidable engagement mechanism.

15. The bridge of claim 14, wherein said interlocking, slidable engagement mechanism provides a minimum threshold of surface contact.

16. The bridge of claim 1, wherein said height adjustment member is slidably mounted on said intonation adjustment member so as to maintain substantially constant contact surface area therebetween.

17. The bridge of claim 1, wherein said intonation adjustment member has a ramp portion for slidably supporting said height adjustment member, said ramp portion forming an acute angle with said base.

18. A bridge for a string instrument having a body and at least one string, comprising:

a base for mounting said bridge on the body of the instrument;

an intonation adjustment member, slidably mounted on said base, for adjusting the horizontal position at which a string is supported by said bridge;

a height adjustment member, movably mounted on said intonation adjustment member, for adjusting the vertical position of the string relative to said intonation adjustment member and thereby adjusting the vertical position of the string above the body;

an intonation adjustor control, connected to said base and to said intonation adjustment member, for selectively adjusting the horizontal position of said intonation member, said intonation adjustor control comprising a first elongate threaded shaft rotatably connected to said base and matingly engaging a threaded aperture in said intonation adjustment member; and height adjustor control, connected to said intonation adjustment member and to said height adjustment member, for selectively adjusting the vertical position of said height adjustment member, said intonation adjustment member having a ramp portion for slidably supporting said height adjustment member, said height adjustor control comprising a second elongate threaded shaft rotatably connected to said intonation adjustment member and matingly engaging a threaded aperture in said height adjustment member.

19. The bridge of claim 18, wherein said height adjustor control further comprises a second coil spring disposed around said second threaded shaft between said intonation adjustment member and said height adjustment member.

20. The bridge of claim 19, wherein said intonation adjustment member includes a front wall having an aperture therein for receiving said second elongate threaded shaft.

21. A bridge for a string instrument having a body and at string, comprising:

a base for mounting said bridge on the body of the instrument;

an intonation adjustment member, slidably mounted on said base, for adjustment the horizontal position at which a string is supported by said bridge; and a height adjustment member, movably mounted on said intonation adjustment member, for adjustment the vertical position of said string relative to said intonation adjustment member and thereby adjustment the vertical position of the string above the body, said intonation adjustment member being connected to said base by an interlocking, slidable engagement mechanism comprising a dovetail interconnection, said slidable engagement mechanism providing a minimum threshold of surface contact.

22. The bridge off claim 21, wherein said interlocking engagement mechanism comprises a channel and slide interconnection.

23. A bridge for a string instrument having a body and at least one string, comprising:

a base for mounting said bridge on the body of the instrument;

an intonation adjustment member, slidably mounted on said base, for adjustment the horizontal position at which a string is supported by said bridge; and a height adjustment member, movably mounted on said intonation adjustment member, for adjustment the vertical position of said string relative to said intonation adjustment member and thereby adjustment the vertical position of the string above the body, said height adjustment member being slidably mounted on said intonation adjustment member by an interlocking, slidable engagement mechanism so as to maintain substantially contact surface area therebetween.

24. The bridge of claim 23, wherein said interlocking engagement mechanism comprises a dovetail interconnection.

* * * * *